US006279659B1

(12) United States Patent
Brunet

(10) Patent No.: US 6,279,659 B1
(45) Date of Patent: Aug. 28, 2001

(54) ASSEMBLY AND METHOD FOR PROVIDING A MEANS OF SUPPORT AND POSITIONING FOR DRILLING MULTI-LATERAL WELLS AND FOR REENTRY THEREIN THROUGH A PREMILLED WINDOW

(75) Inventor: Charles G. Brunet, Houston, TX (US)

(73) Assignee: Weatherford Lamb, Inc., Houston, TX (US)

( * ) Notice: Subject to any disclaimer, the term of this patent is extended or adjusted under 35 U.S.C. 154(b) by 0 days.

(21) Appl. No.: 09/175,710

(22) Filed: Oct. 20, 1998

(51) Int. Cl.[7] ..... E21B 43/00

(52) U.S. Cl. ..... 166/313; 166/117.5; 166/117.6; 166/242.5; 166/381; 175/78; 175/80

(58) Field of Search ..... 166/50, 117.5, 166/117.6, 241.1, 242.5, 313, 381, 384; 175/78, 79, 81, 82, 83, 61

(56) References Cited

U.S. PATENT DOCUMENTS

| | | | | |
|---|---|---|---|---|
| 1,625,600 | * | 4/1927 | Getty | 166/117.6 |
| 1,851,319 | * | 3/1932 | McCoy et al. | 166/117.5 X |
| 1,923,448 | * | 2/1933 | McCoy et al. | 166/117.5 |
| 2,158,329 | * | 5/1939 | Kinzbach | 166/117.5 |
| 2,942,671 | * | 6/1960 | Schramm | 166/117.5 |
| 2,948,341 | * | 8/1960 | Fredd | 166/117.5 |
| 3,710,864 | | 1/1973 | Mitchell . | |
| 4,002,203 | * | 1/1977 | Terral | 166/117.5 |
| 4,763,519 | | 8/1988 | Comeau . | |
| 4,872,708 | | 10/1989 | Abreo, Jr. . | |
| 5,163,521 | | 11/1992 | Pustanyk et al. . | |
| 5,293,945 | | 3/1994 | Rosenhauch et al. . | |
| 5,311,936 | | 5/1994 | McNair et al. . | |
| 5,318,121 | | 6/1994 | Brockman et al. . | |
| 5,410,303 | | 4/1995 | Comeau et al. . | |
| 5,435,392 | | 7/1995 | Kennedy . | |
| 5,458,209 | | 10/1995 | Hayes et al. . | |
| 5,472,048 | | 12/1995 | Kennedy et al. . | |
| 5,484,017 | | 1/1996 | Coon . | |
| 5,579,829 | | 12/1996 | Comeau et al. . | |
| 5,602,541 | | 2/1997 | Comeau et al. . | |
| 5,613,559 | * | 3/1997 | Williamson et al. | 166/381 |
| 5,615,740 | * | 4/1997 | Comeau et al. | 166/117.5 X |
| 5,732,773 | * | 3/1998 | Parks et al. | 166/242.1 X |
| 5,884,698 | | 3/1999 | Hughes et al. . | |
| 6,012,516 | * | 1/2000 | Brunet | 166/50 |
| 6,012,526 | * | 1/2000 | Jennings et al. | 166/298 |
| 6,024,169 | * | 2/2000 | Haugen | 166/298 |

* cited by examiner

*Primary Examiner*—David Bagnell
*Assistant Examiner*—Jong-Suk Lee
(74) *Attorney, Agent, or Firm*—Parks & Associates

(57) ABSTRACT

An assembly for drilling at least one lateral well from a well bore having a longitudinally premilled window formed therein and having a first orientation key-way member formed in the premilled window and in communication with the premilled window and located on the down hole portion of the premilled window and having a second orientation key-way member formed in the premilled window and in communication with the premilled window and located on the up hole portion of the premilled window. The window is provided with a cover for closing the premilled window and first and second orientation key way members from fluid communication. A whip stock is provided for drilling at least one multilateral well. A key is provided which is spring loaded for being received into the premilled window and guided into locking engagement in the first orientation key way as the key is lowered down hole. A method of using such assembly comprising adding a premilled window to the casing string and setting it and hen running an orientation tool to orientate the window and cememting the well casing. The cement, temporary orientation key, temporary mule shoe, and the cover are drilled out and a whip stock is set by landing the key in the key-way while lowering the whip stock. Once the whip stock is set the lateral well is drilled. Reentry is achieved by having a spring loaded key received into the premilled window and engaged upon up hole movement.

42 Claims, 7 Drawing Sheets

ASSEMBLY AND METHOD FOR PROVIDING A MEANS OF SUPPORT AND POSITIONING FOR DRILLING MULTI-LATERAL WELLS AND FOR REENTRY THEREIN THROUGH A PREMILLED WINDOW

BACKGROUND OF THE INVENTION

This invention relates generally to apparatus and methods of using the apparatus for drilling lateral or multi-lateral wells from a vertical well, for the purpose of producing more oil and gas from the subsurface formations and for entry and reentry into said multi-lateral wells after hey have been completed. Specifically this invention relates to novel and improved assemblies and methods for the installation and completion of lateral well bores emanating from a main casing or a tubular walled member which may be vertical, deviated or horizontal and their entry or reentry.

Since the increase in usage of lateral or multi-lateral well drilling, there has also been an increase in the problems associated with their drilling because they are being used in more and different well conditions and at more extreme angles of deviation from the vertical well bore than ever before. Thus many techniques have been developed to solve some of these problems but only with the result of creating other and different problems, not the least of which is providing a simple and universal assembly and method which can be used for both drilling and completion and also entry and reentry at a later date.

The prior art is replete with keys formed, as for example in U.S. Pat. No. 4,415,205, on the inside of the well bore and casing and which project inwardly to locate and orient the whip stock and other tools for drilling a lateral well. These internally projecting keys which function by extending radially inward from the casing wall from for orienting and positioning a whipstock, restrict the internal clearance through the casing. This is a problem because it limits the operating diameter of the well bore which restricts the ability to operate other tools in the well when needed. Further because of the large forces used in wells with the pipe and tools being moved up and down, these internal projections are subject to being damaged or destroyed by tools working in the casing, which would render the projections useless for their intended purpose. Thus the expense of a window section would be completely lost, as well as access to that oil bearing strata without great expense. This is especially true in the case of reentry at some later time after the well has been in service for some time and some workover operation is needed to be performed.

Also as the multi-lateral drilling assemblies have become longer and more complex these assemblies and their methods have become more likely to have problems associated with retrieveing and manipulating them in the well bores.

A yet further problem is finding the exact location of the window junction in the well bore after it has been properly oriented. The prior art, such as in U.S. Pat. No. 5,579,829, has used spring loaded keys, for locating and orienting operations related to the geological formulations for these lateral well bores. However many of these keys were equipped with multiple sets of keys which must mate with permanenly mounted key-receivers located in the main casing. This could be a relatively complex arraignment and procedure and it required diligence and accuracy in placing the correct combinations of keys in the system accurately. Also it required a very detailed and complicated record keeping procedure for any future work which might be done in the well for the future. Also as the various key-receives for each well could be different it required the maintenance of a large inventory of each key system and this problem is growing as the number of such systems is increasing around the world.

Also in these spring loaded key systems the keys while easy to engage once the key was directly over the key hole or key way, these key holes and ways were of relatively small square area and a significant amount of time could be required for fishing around to find the exact position to allow the key to spring out and mate with the key holes and key ways. In most cases the keys had to hit key holes and ways with target areas measured in 25 to 50 square inches.

Also in the prior art many times these small target areas could become filled with debris from the well fluids and then the spring loaded key would not have a space into which it could engage, with the corresponding problems of not being able to set the whip stock or other tools without additional work and runs back into the hole to clear the key hole or key ways.

Also in the prior art these premilled windows had to be covered with a metal sleeve which in some cases were pulled from the hole and this increased the costs of well operation, as those skilled in the art will appreciate, every trip into the hole adds costs to a well operation. Some of the other prior art patents attempted to solve this problem by putting metal covers permanently fixed to the premilled windows which were then required to be milled out after the well casing was cemented and set in place. The problem with this approach is that many metal cuttings were dropped and dumped into the well which has the potential for creating problems with other well operating equipment and the circulation of mud and other equipment which is hydraulically driven by the well fluids.

Yet another problem in the prior art is the reentry of the at least one multi-lateral well once it has been drilled and completed, because in most cases the whip stock and other orientating devices have been removed from the well and the entry way to the multi-lateral well has few if any means of identifying the entrance to the at least one multi-lateral well bore.

Also a problem, which those skilled in the are will appreciate, is the problem of being able to move from a vertical position in a casing or tubular wall to a kicked out position from the vertical position in a casing or tube, which must occur, to achieve reentry into at least one of the multi-lateral well bores. While there have been many ways in the prior of achieving such a kick out position such as resetting a whip stock, etc., all of these ways and tools required multiple entries back into the well to first set the orientation piece and then to run the tool which was going to actually reenter the at least one multi-lateral well with the added costs associated with multiple re-runs back into a well.

A further problem was even finding the proemilled window because if the well is an older one many of the keys or indicators which were originally attached or fixed in the casing or tubular walls have been damaged or destroyed by other work that has occurred in the well since the drilling of the at least one multi-lateral well.

Also in the prior art the ability to reenter a well is many times totally dependant on the accuracy of the historical records kept on a well and the older the well the less likely the well records were likely to be available for use in the reentry process which rendered reentry either impossible of very expensive.

OBJECT OF THE INVENTION

It is an object of this inventin to provide apparatus and methods of using the apparatus for drilling lateral or multilateral wells from a vertical well or tubular wall, for the purpose of producing more oil and gas from the subsurface formations which is improved over the prior art and has a higher degree of success in all wells where it is used. This includes wells where this apparaus and method are used in new wells or where reentry is needed in an older well using this apparatus and method for additional work in the lateral or multi-lateral or used in any combination there of to achieve the purpose of enhanced production of the wells.

One of the benefits of this invention is that the key used in this inventin does not project into the well bore, so that the full casing bore is fully clear for other well operations without losing the effective ability to re-enter the well and have the key lock into place at any time whether on new installations or old well reentry.

Further, it is an object of this invention to have the key and key way or hole out of the passage way of the well bore to prevent damage to either the key or the key way when other tools are being used in the well bore whether after completion or after another well further down hole in the casing, if this multi-lateral well, is drilled or completed. By providing the key and key way or hole in a manner where they are out of the passage way of the well bore, the key and key way or hole can not be damaged by other tools or production equipment being run up and down the well bore, which could make the key and key way useless.

Yet another object of this invention is to provide a key and key way or hole which are inexpensive and simple to form at the time of manufacture and to also use in the well both at the time of insertion in a new well but also upon reentry in the future after the well has had the apparatus and method of this invention installed at an earlier time.

Part of the success of drilling a lateral is to orient the window section in the proper orientation both in the height or depth of a will but also in a selected direction from those possible and desired from the 360 degrees possible in a well, because that will determine the placement of a whip stock to drill the well. In this invention because of the shorter window and key section which are only slightly larger than the window itself, the whole casing of a well is easier to maneuver to the desired orientation, while the well casing is suspended from the drilling floor, before cementing it in place. Thus because of the shorter window section it is easier to rotate the whole casing or tubular walls of pipe with out having the window sectin bind in the hole.

Also in the case of this invention there would not be any need for keeping complicated historicqal records on where exactly the key way or hole is located in the casing or tubular wall of a well in this invention because the key way or hole is part of the window location itself in the well and if the window location is know the key way or hole is known or can be found easily.

It is also an object to form a key way or hole which does not have many complicated parts and which is simple to operate in the down hole environment in which this invention is operated in a well.

In addition to being simple the key and key-way or hole of this invention is easy to mate and does not require timely maneuvers either or both up and down the well or in the 360 degrees of the well bore to allow the key and key-way or hole to find each other and mate.

The ability to easily find the key-way or hole in this invention is increased by the fact that the key operns into the window and then is guided by the window walls or it's "sills" about the opening of the window in the well casing as the tools or whip stock are lowered further down the well until the window's "sills" guide it to the key-way or hole and the key is guided into place therin. In the case of landing in the up hole key-way, it is simply a matter of pulling up hole after the key is opened in the window to allow the window's "sills" to guide the key to the key-way or hole and into place therein.

Thus it is a further object of this invention to provide a key and a key-way or hole which have the whole window to serve as a preliminary target for the key to find and mate with and then to serve as a guide way to guide the key downward as the key is moved down hole or upward as the key is moved up hole, until it finally comes to rest in the key-way or hole at the bottom of the key-way or hole or the up hole key-way or hole. Thus in this invention the key has a target for mating which can be several hundred square inches in open surface area rather than twenty five or fifty square inches of open surface area as a target as was the case in the prior art key-ways or holes.

The guiding of the key by the window wall or it's "sill" into the key way or hole is important for another reason in this invention, because it allows the key to clear any debris which may have collected in the key-way or hole during other operations in the well casing prior to the setting of the key in the key-way or hole. Thus using the controlled full weight of the running tubing string and the keys movement into the key-way or hole by gradual movement downward, it will clear almost any debris which may have found its way into the key-way or hole and the key will properly set in the key-way or hole with out problems.

Also in this invention some of the keys have metal edged leading surfaces which effectively become cutting or clearing blades to remove any debris which may have been left behind in the key way or hole for the very purpose of clearing the key way or hole of debris. This is especially true for the down hole key-way because it has more opportunity to fill with debris.

In this invention it is yet another object to provide a composite cover in some of the embodiments of this invention for covering the window of the apparatus of this invention as the cementing methods or operations occur. Thus in this invention after the cementing operations are complete and the time comes to drill out the window and it's cover to commence the lateral drilling of the well, no metal shavings are deposited into the well to create potential problems in the well operating equipment.

It is also the object of this invention to have performed segments provided in the cover of this invention to provide its rapid and easy removal from the junction section upon its being engaged by the drill bit used in the process to clear the casing string or tubular walls.

It is also a object of this invention to have the key and down hole key-way or hole operated in conjunction with a packer. Thus having the key coming to rest at the bottom of the key way or hole, it activates the setting of the packer by stopping the packer head from advancing downward while the body of the whip stock continues downward some distance to set the packer and form the platform which can secure the whip stock for the drilling of a lateral well.

It is also an object of this invention to have the up hole key-way or hole operated in conjunctin with a kick tool. Thus in having the key on a kick tool come to rest at the top of the up hole key-way or hole, it activates the kicking tool to kick out upon additional up hole pressure being applied and then provides guidance for the kicked out tool as it is being lowered into the multi-lateral well bore.

Yet further and additional benefits and improvements of the invention will be appreciated by others skilled in the art and those advantages and benefits of the invention will become present to those skilled in the art upon a reading and understanding of the following detailed description.

BRIEF DESCRIPTION OF THE DRAWINGS

This invention may be practiced in certain physical forms and arrangements of the parts herein described, but a preferred embodiment of which will be described in the specification and illustrated in the accompanying drawings which form a part hereof.

While the invention will be described in connection with the preferred embodiment, it will be understood that it is not intended to limit the invention to that embodiment. On the contrary, it is intended to cover all alternative, modifications and equivalents as may be included with the spirit of the invention as defined in the appended claims.

DESCRIPTION OF PREFERRED EMBODIMENT

The purpose of this invention is for providing an assembly and method for drilling at least one multi-lateral well bore from a well bore using a junction section member having a premilled window and a first orientation key-way for supporting an assembly and performing a method to drill at least one multi-lateral well and a second orientation key-way for supporting an assembly and performing a method for reentry into the at least one multi-lateral well drilled after it is drilled.

Figures 1, 2, 3:
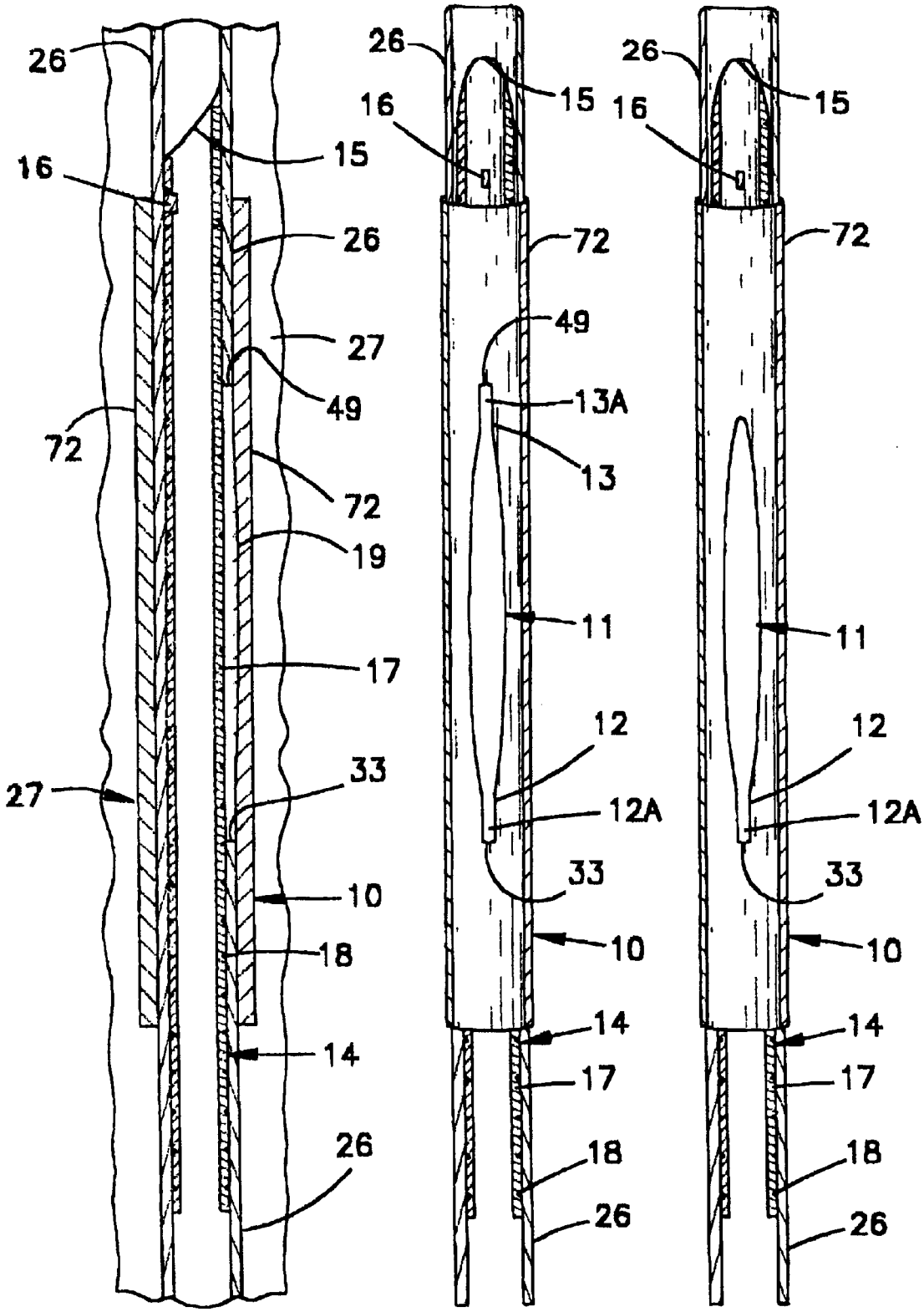
FIG. 1 is a top view in partial section of the junction section of this invention with a window and a first orientation key-way showing and the cover member in place, and a wrap cover thereabout.
FIG. 2 is a top view in partial section of the junction of this invention with a window and the firs and second orientation key ways showing and the cover member in place, and a wrap cover thereabout.
FIG. 3 is a side view in cross section of the junction section of this invention with the cover member in place and with the first and second orientation key-ways and showing the special section of the cover and a wrap cover thereabout.

Referring now to FIG. 1 the junction body of this invention is generally shown at reference number 10. The junction body 10 made of a tubular material has a premilled longitudinal window 11 formed in the junction body 10. In the junction body 10 is also formed a first orientation key-way 12 which is located on the down hole orientation of the premilled longitudinal window 11 of the junction body 10.

In yet another embodiment, as shown in FIG. 2, in addition to first orientation key-way 12 there may also be in the junction body 10 formed a second orientation key-way 13 which is located on the up hole orientation of the premilled longitudinal window 11 of the junction body 10. Each of these first and second orientation key-ways 12 and 13, whether singular or in pairs, are formed in the premilled junction body 10 along the longitudinal premilled window 11 for allowing communication between the longitudinally premilled window 11 and the first and second orientation key-way 12 and 13 and for providing support and positioning for drilling at least one multi-lateral well or for the entry or reentry therein, as will be further explained herein.

In one embodiment, also shown in FIG. 2, the first and second orientation key-ways 12 and 13 are formed substantially into U-shaped channels 12A and 13A which are substantially vertically in alignment with each other and in centered alignment with the premilled longitudinal window 11. This centered alignment is important because whether the first and second orientaion key-ways 12 and 13 are used as pairs or singularly, they are in centered alighment with the window 11 it allows the entry through the window 11 to be more accurate. Accurate entry is important because inaccurate entry causes wean and tear on the window 11 and the tools which are run and re-run in the multi-lateral well operations.

A temporary cover 14, in one embodiment which while shown in FIG. 1 & FIG. 2 is best seen in FIG. 3, is fitted in the junction body 10 for closing the longitudinally premilled window 11, and the first and second orientation key-ways 12 and 13 from fluid communication from either the outside or the inside of the tubular walls 26 of the junction body 10. It should however be said that the material used to form the temporary cover 14 should be a soft metal or as will be disclosed herein a non-metallic sleeve 17, as best seen in FIG. 3, which has preformed in the non-metallic sleeve 17 special sections 18 of reduced radial strength orientation for easy removal by a drill bit once a drill bit engages such a special section 18. The purpose of this seal will be come more apparent as will be herein after discussed and understood from the discussion of the methods of using the full assembly of this invention. In addition to the temporary cover 14 in some applications a wax layer 19 may be laid into any voids which the temporary cover 14 does not fill for the purpose of making the exterior surface smooth with the wall of the junction body 10. Also in some applications an outer wrapper cover 72 may also be added for additional protection and to give the junction section 10 a finished look over the window 11 and the first and second orientation key way 12 and 13. It should also be understood that if the cover 14 was mounted on the outside in an embodiment the wax layer 19 would be added to the inside of the junction body 10 to make the interior surface smooth with the inside wall of the junction body 10 and still not depart from the teachings of this invention.

Figure 4:
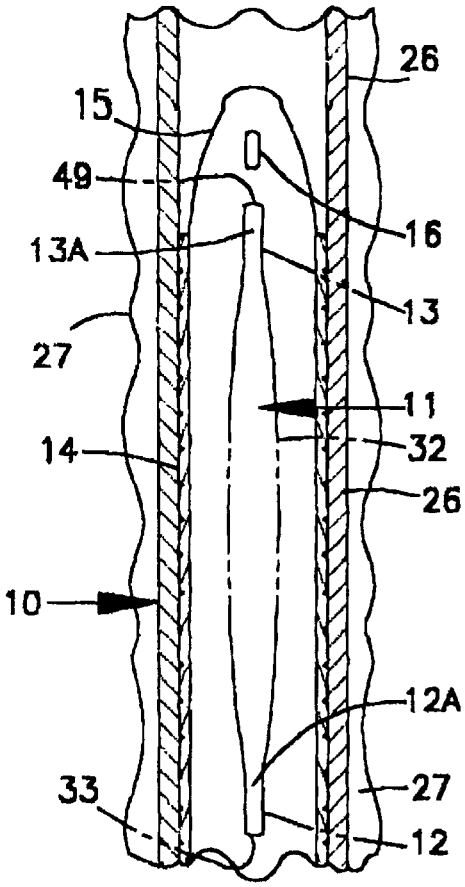
FIG. 4 is a top view of the junction section of this invention with the first and second orientation keys ways showing, as well as the temporary mule shoe and orientation key with the cover member in place and placed in the well bore of a well and a window and the first and second orientation key ways shown n dashed phantom lines.
Figure 5:
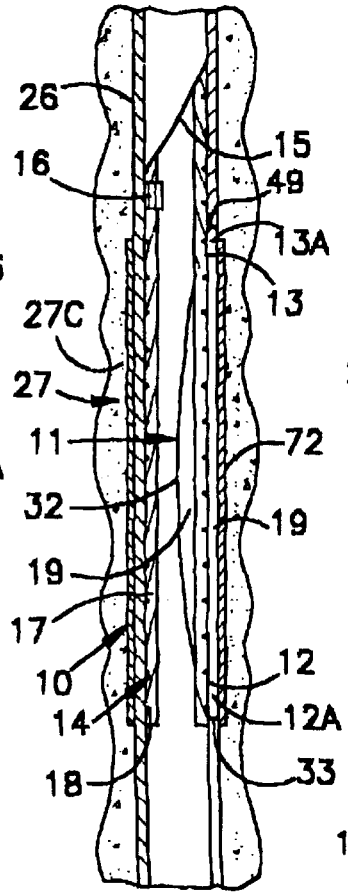
FIG. 5 is a side view in partial cross section of the junction section of this invention with the first and second orientation key ways showing and the junction section set in concrete with the cover member, and temporary mule shoe and orientation key still in place, and the tubular walls set in concrete.

The up hole orientation of the temporary cover 14 has formed in it a surface sometimes referred to as a "Mule Shoe" 15 for aiding in positioning the junction section 10. Also provided in the temporary cover 14 is temporary orientation key 16 which is set in a known orientation to the first and second orientation key-ways 12 and 13 for the purpose of providing a positive means to determine the orientation of said longitudinally premilled window 11 formed in the junction section 10 and the first and second orientation key-ways 12 and 13, as shown in FIGS. 4 and 5. This temporary orientation key 16 is used in the case where a well has been drilled and it is being prepared for cementing about the wells tubular walls 26 such as casing in the well. In this case an orientation tool, not shown, is lowered to verify the orientation of the temporary orientation key 16 which then allows confirmation of the orientation of the premilled window 11 and the first and second orientation key-ways 12 and 13 to be sure that they are oriented in the direction desired for the at least one multi-lateral well to be drilled. Once oriented the well bore 27, tubular walls 26, and junction section 10 are cemented together into place in the space 27 C of the well bore 27, as seen in FIG. 5, as part of the completion process which permanently holds the desired orientation of the window 11 and the first and second orientation key-ways 12 and 13 for the life of the well. This life time orientation is especially important for the second orientation key-way 13 for the reentry back into the drilled multi-lateral wall after the competition of the well either just after its completion or at a much later date.

Figure 6:
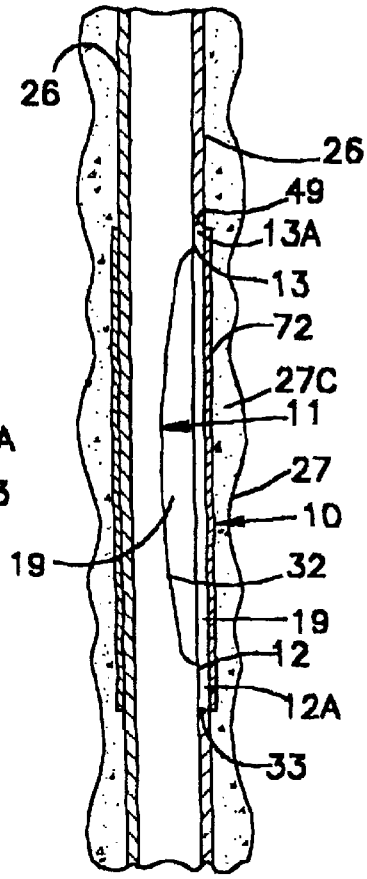
FIG. 6 is a side view in partial cross section of the junction section of this invention with the first and second orientation key ways showing and the junction section set in concrete with the cover member, temporary mule shoe and orientation key drilled out of the junction section and set in concrete but before the at least one multi-lateral well drilling has commenced.
Figure 8A:
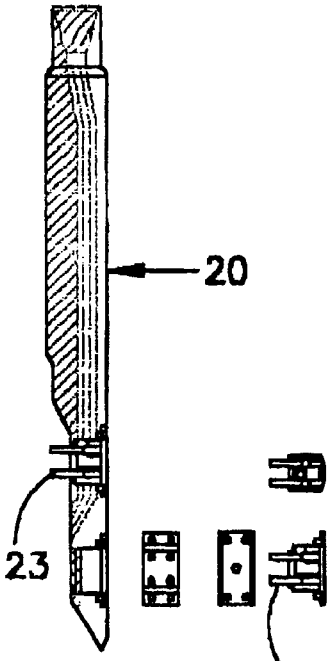
FIG. 8A is a side partial section view of a running tool with attachments used to put the whipstock, key, and packer in the junction into the well.
Figure 7:
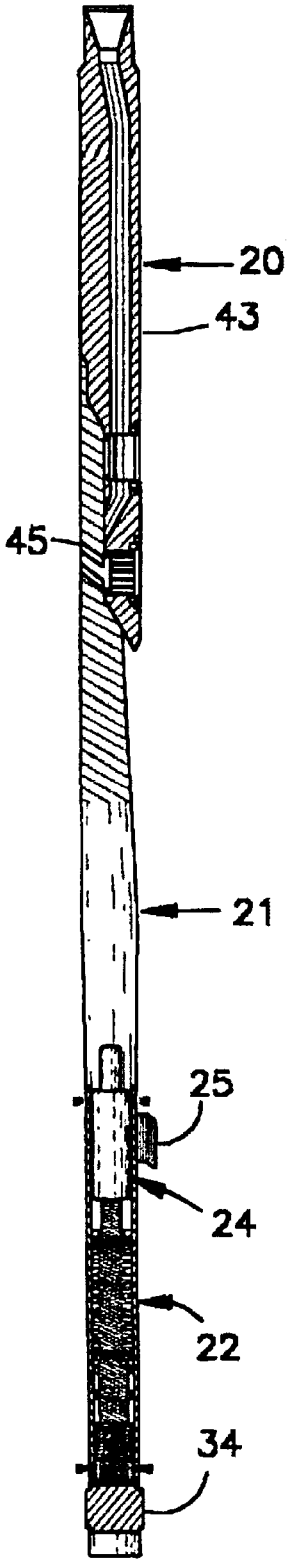
FIG. 7 is a side and partial section view of the whipstock and key and packer configured for being run into the well on a running tool.

After the junction body 10 is oriented as desired, and the cementing of the well proceeds to secure the casing or tubular walls 26 in the well bore 27. The excess cement is then drilled out of the tubular walls 26 and the junction body 10. The result of this process of drilling out the cement, as best seen in FIG. 6, is that the temporary cover 14 would also be removed along with the mule shoe 15 and temporary orientation key 16, if they were located on the inside of the junction body 10, as it is disclosed in this one embodiment. Once drilled clear, a running tool 20, as shown in FIG. 8A, would be mounted to a whip stock 21, as shown in FIG. 7, which is engaged with a packer assembly 22 and key tool 24, as shown generally in FIG. 7 and in more detail in FIG 10 and FIG. 11. The running tool 20 is connected to the whip stock 21, in at least this embodiment by shear pins 23, as shown in FIG. 8A. It will be understood later that running tool 20 could be configured as a retrieving tool 43 shown in FIG. 8B by the addition of a spring loaded hooking tool 45 to be used also for retrieving the whipstock 21. The whipstock 21 is slidably connected to the key tool 24 and to the packer assembly 22 for functional engagement as will be described and as shown in FIG. 9 for down hole placement in the proper position in the window 11. Once in place and as part of setting the whip stock 21 the shear pins 23 are sheared off and the running tool 20 is removed.

The packer assembly 22 is connected to a key tool 23, which has a spring loaded key 25 for springing the key 25 out into the window 11 of the junction body 10 when the packer assembly 22 and key tool 24 passes the open window 11 of the junction body 10. Once open the key 25 will strike the walls of the window or window sill 32 and stop the packer assembly 22 and whip stock 21 from continued rotation, which signals the operator to then lower the key tool 24, key 25, packer assembly 22, and whip stock 21 straight down hole which allows the key 25 to follow the window sill 32 to the first orientation key-way 12 which is in communication with the window 11. The key tool 24 and key 25 will continue downward until stopped in engagement with the back portion of the U-shaped channel 33. Once the key tool 24 comes to a stop the packer 34 on assembly 22 connected to the key tool 24 through mandrel 63 also comes to a stop, but the whip stock 21, which is connected in slidable engagement over the mandrel 63 with the packer assembly 22, continues downward which thus compresses the packer 34 and sets it in the tubular walls 26. Once the packer 34 is compressed the whip stock 21 will have been positioned both at the proper level of the window 11 and oriented in the desired direction to deflect the drill bit once the at least one multi-lateral well bore is started. It will be appreciated that the key tool 24 and the first orientation key-way 12 have provided both a means for correct orientation and simplicity of operation in conjunction with the rest of the invention to achieve the proper orientation and setting of the whip stock 21 and packer assembly 22 for drilling at least one multi-lateral well.

Figure 12:
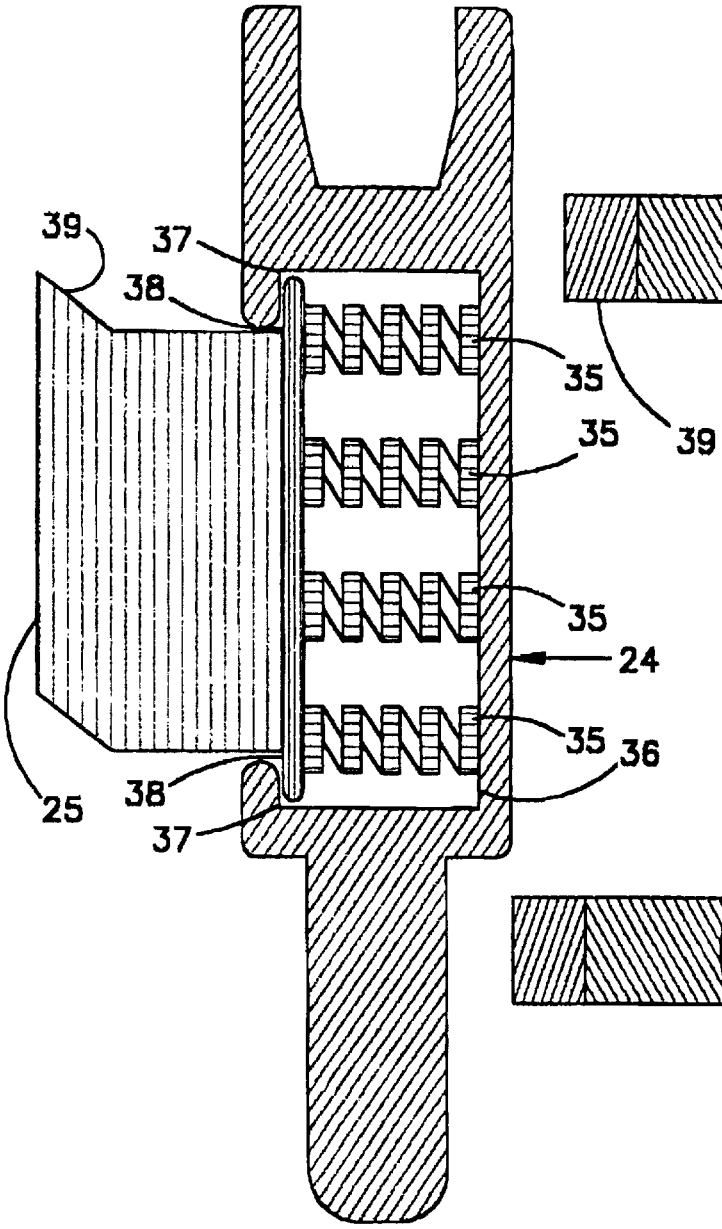
FIG. 12 is a side and partial section view of the key, key body, and biasing spring used to set the key in the window and key-way of the junction section.
Figure 14:
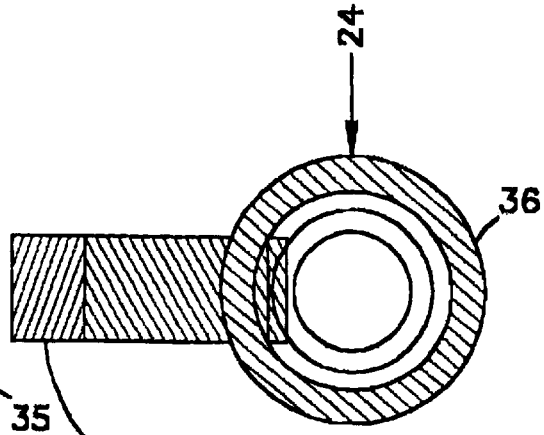
FIG. 14 is a back and partial section view of the key, key body used to set the key in the window and key-way of the junction section.
Figure 13:
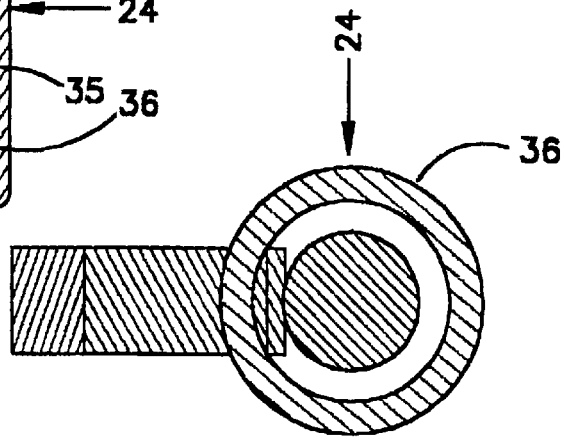
FIG. 13 is a front and partial section view of the key, key body used to set the key in the window and key-way of the junction section.

The key tool 24, which is best shown in FIGS. 12, 13, & 14, is composed of a key 24 and a driving spring 35 which is placed in a receiver box 36 and has a stop 37 for stopping against a key stop plate 38 when the key 24 is fully extended. It should be noted that the key tool 24 has a down hole hooked surface 39 for engagement with the first orientation key-way 12. It will be understood by those skilled in the art, that as the down hole hooked surface 39 slides into the first orientation key-way 12 it would clear any debris which may have become deposited. As this down hole hooked surface 39 would have great forces applied to it by the string on which it would be run into the hole, the key 25 performs a self cleaning function in the process of it being set in place for the orientation of the whip stock 21 and the setting of the packer 34 in the well to provide from which the multi-lateral well may be drilled.

Figure 10:
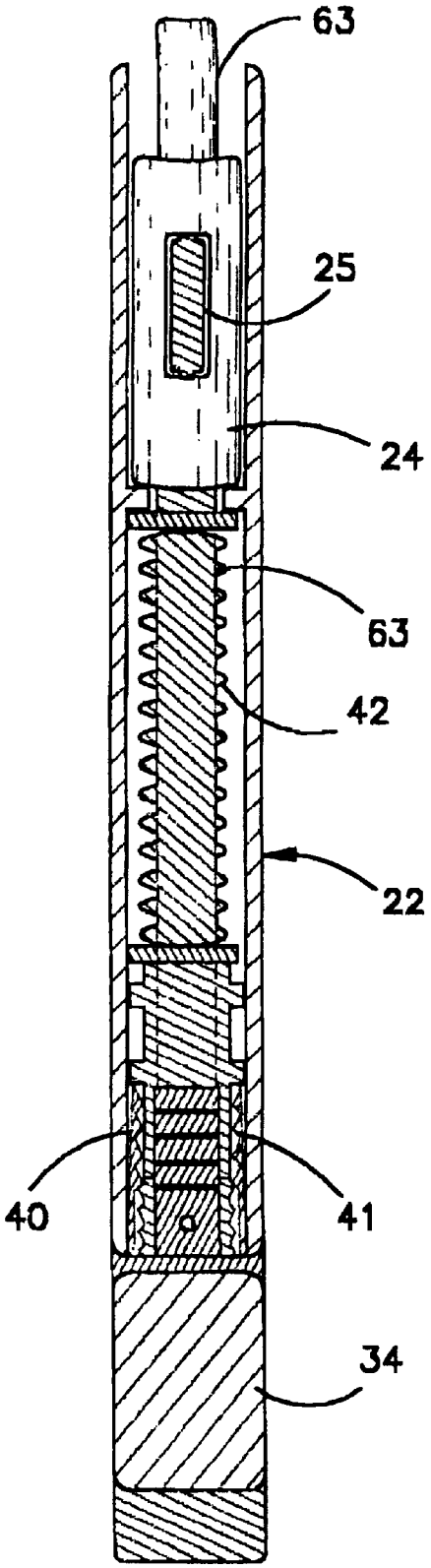
FIG. 10 is a top view in section and with the cover removed of the key and packer assembly to show the relationship of the key and packer in a non set configuration.
Figure 11:
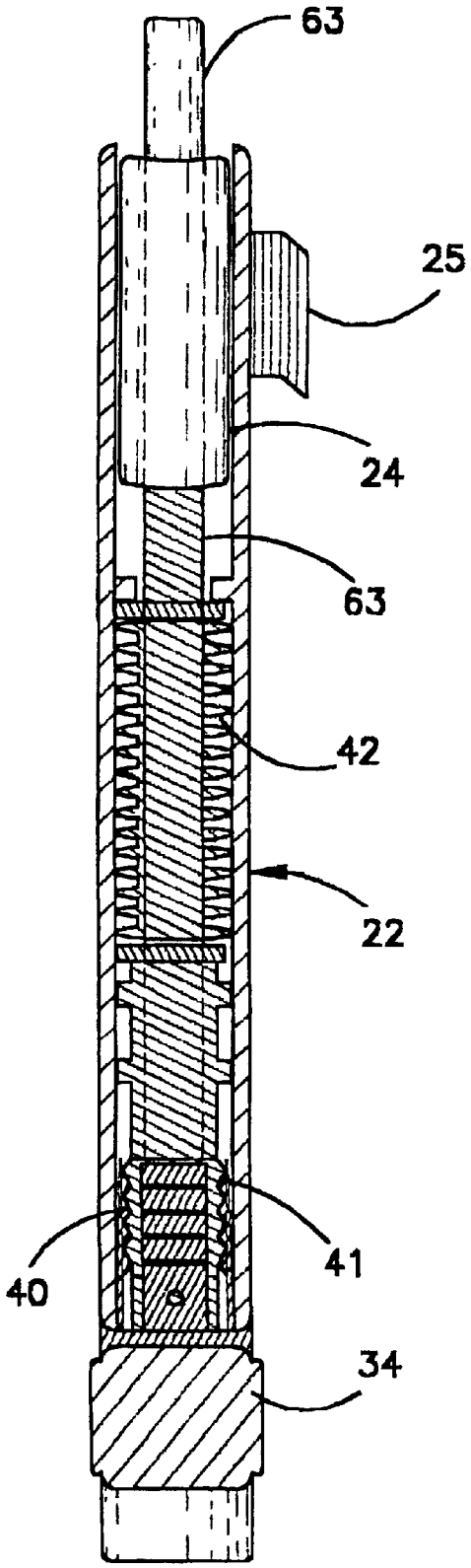
FIG. 11 is a side view in section and with the cover removed of the key and packer assembly to show the relationship of the key and packer in a set configuration.

The packer assembly 22 as shown in FIGS. 10 & 11 also has collets 40 and 41 which are engaged upon the stopping of the downward motion of the packer 34 by the key tool 24 as the whip stock 21 is moved further down hole, such that they collets 40 and 41 lock to hold the packer 34 in a compressed and secure state for the drilling of the at least one multi-lateral well. In some embodiments a spring 42 would be provided to be compressed as the collets 40 and 41 are pressed into engagement for the purpose of storing mechanical energy to aid in the releasing of the collets 40 and 41 when it is desired to remove the whip stock 21 from the junction section 10.

Figure 8B:
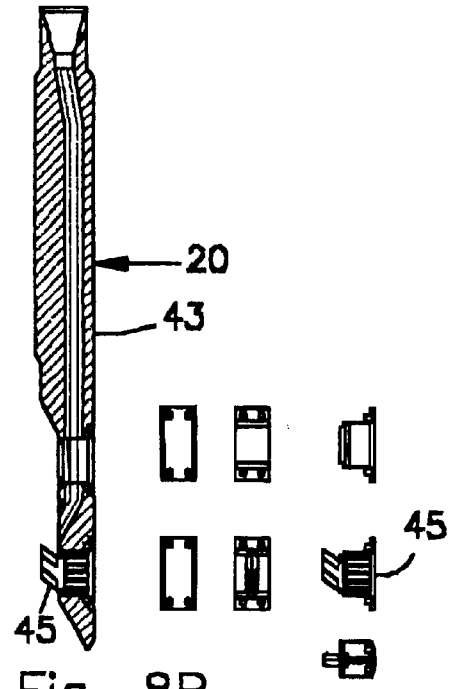
FIG. 8B is a side partial section view of a running tool with attachments used to pull the whipstock, key and packer out of the junction section and the well after completion of the drilling or at least one multi-lateral well.
Figure 8:
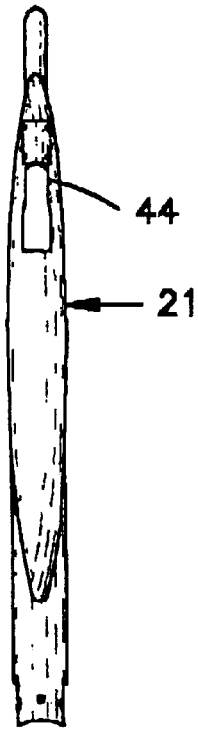
FIG. 8 is a top view of the whip stock of this invention separated from the key and packer
Figure 9:
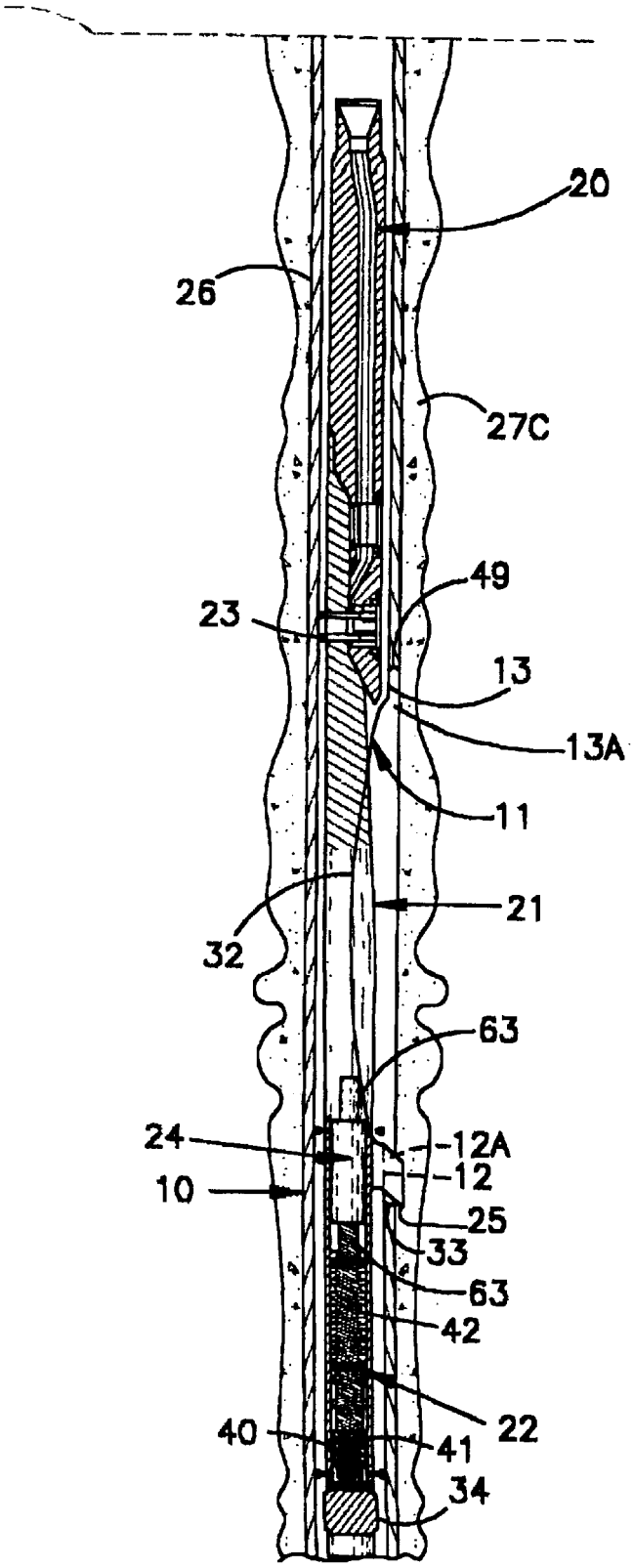
FIG. 9 is a side and partial section view of the whip stock and key and packer configured for being run into the well on a running tool and showing the configuration put into a well and the key member operationally functioning with the first orientation key way.

Once it is desired to remove the whip stock 21 a running tool 20 is configures as shown in FIG. 8B to be run as a retrieving tool 43 with a hooking tool 45 replacing shear pins 23 and it is run into the tubular walls 26. The whip stock 21 is provided with a receiving surface 44 into which a spring loaded hooking tool 45 located on the retrieving tool 43 is located and the retrieving tool 43 pulls the whip stock 21 and packer assembly 22 out of the well.

Figure 16:
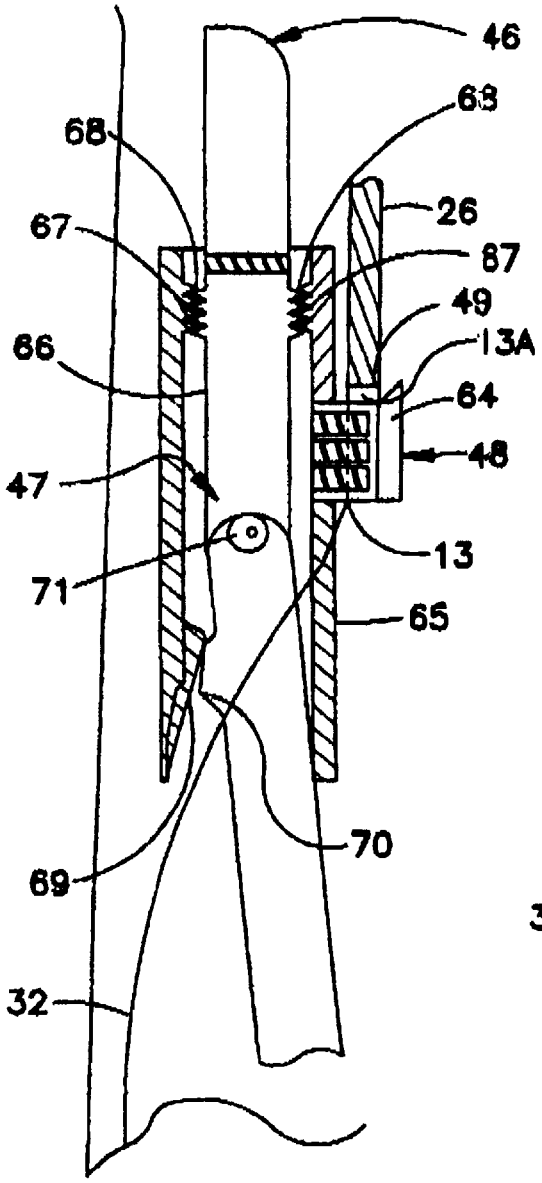
FIG. 16 is a side and partial section view of the up hole key and a kick tool in a kicked alignment for reentry into the at least one multi-lateral well to be used in the second orientation key-way as shown in the junction section in a well.
Figure 15:
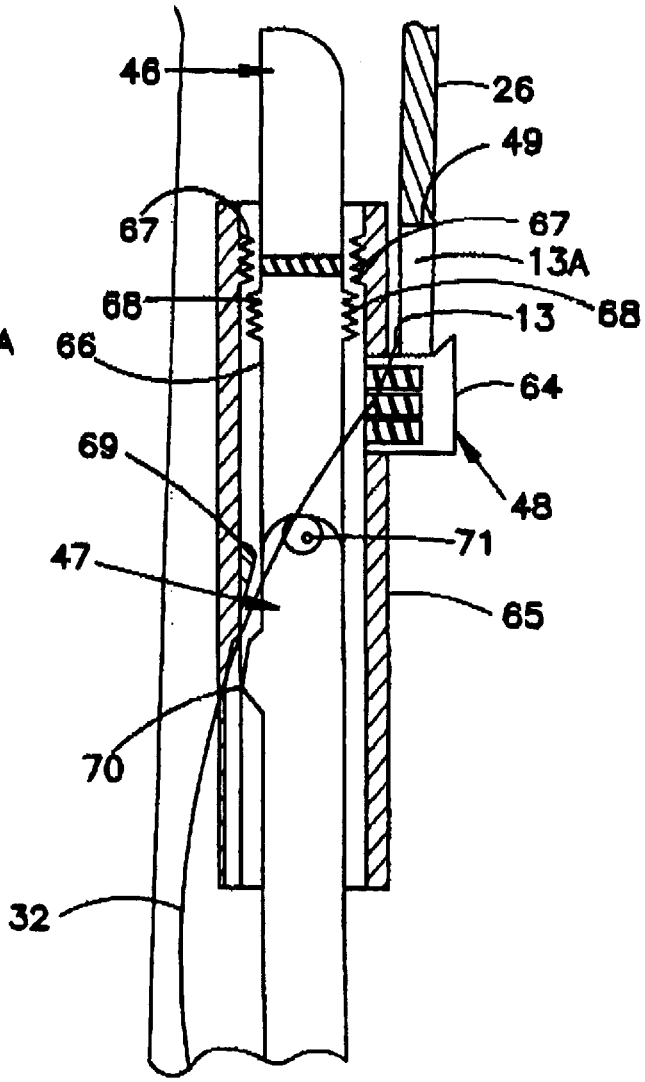
FIG. 15 is a side and partial section view of the up hole key and a kick tool in a straight alignment or running position to be used in the second orientation key way as shown in the junction section in a well.

When it is desired to reenter the well a reentry tool 46 is run into the well with a kick tool 47 conneced to it. The reentry tool 46 has a key tool 48 with a spring loaded key 64 located on the reentry tool 46 for being received into the longitudinally premilled window 11 of the junction body 10. Once open the spring loaded key 64 on the key tool 48 will strike the walls of the window or window sill 32 and stop the reentry tool 46 from continued rotation, and then the operator of the well can pull striaght up on the key tool 48 and reentrly tool 46 as the key tool 48 and spring mounted key 64 follow the window sill 32 to the second orientation key-way 13 which is in communication with the window 11 and allows the key tool 48 to continue until stopped in engagement with the back portion of the U-shaped channel 49. Once the key tool 48 and spring loaded key 64 come to a stop the kick tool 47 may be activated to kick a tool, as shown in FIGS. 15 & 16, out of vertical alignment. Once kicked out of vertical alignment then upon letting down on the kicked tool 47, as shown in FIGS. 15 & 16, it will be properly lowered into the well bore of the at least one multi-lateral well for proper reentry therein. Further it should be understood that once the reentry tool 46 has been kicked out the reentry tool 46 with its key tool 48 and spring loaded key 64 may stay in the stopped position in the 2nd orientation key-way 13 and just the reentry tool 46 in a kicked position would be lowered into the well bore of the at least one multi-lateral well.

In this embodiment of a mechanical kick tool 47 as shown in FIGS. 15 and 16, where the mechanical kick tool 47 and the spring loaded key 64 are shown in a running configuration as in FIG. 15 and a kicked configuration as in FIG. 16, the spring loaded key 64 is connected to sleeve housing 65. Thus once stopped, as shown in FIG. 16, the operator continues to add up hole pressure on the mechanical kick tool 47, which causes the kicking element 66 to be moved through the sleeve housing 65. Inside of the sleeve housing 65 is a cam surface 69 which is moved into position against another cam surface 70 located on the kicking element 66, which causes reentry tool 46 to be kicked out. This kick out is further aided by a pivot 71 which allows some articulation of the parts. Once kicked out the mechanical kick tool 47 is locked into position by mating ratchet threads 67 on sleeve housing 65 being moved to mate with ratchet threads 68 on the kicking element 66. This locking of ratchet threads 67 and 68 produces a locked kicked position for reentry back into a lateral well bore when the mechanical kick tool 46 is lowered downward in the well.

It will be appreciated by those skilled in the art that the kick tool could be of a mechanical type which would be triggered by additional up hole pressure after the key 64 and key-way 13 are initially stopped against each other, or it could be activated by hydraulic pressure once it is known that the key 64 is in the key-way 13, or any other means which is known in the prior art with out departing from the teachings of this invention.

Those skilled in the art will further appreciate that the above disclosed embodiments of the assembly for providing a means for support and positioning for drilling at least one multi-lateral well from a well bore in a well having tubular walls and for providing a means for entry and reentry into and through the longitudinally premilled window can be used in different combinations and using different methods dependint on the particular conditions and the desire of the user.

For example in a simple multi-lateral well, the basic method for using the assembly comprises adding a junction section 10 having at least one premilled window 11, and at least one orientation key-way 12 in communication with the at least one premilled window 11 to a casing string or tubular walls 25 in preparing to complete the well. Then setting the casing string 26 and the junction section 10 in the well bore and orientating the junction section 10 with the premilled window 11 and at least one orientation key-way 12 in the direction disired to be drilled and at the desired level in the well to be drilled. This orientaion step is usually done with a running tool 20 having a means to read the temporary orientation key 16, so that the operator will know to what degree to turn the whole casing to bring the premilled window 11 and the at least one orientation key-way 12 to the desired direction. Next a cementing operation would be carried out to cement the well casing or tubular walls 26 and the junction section 10 in permanent proper orientation, as part of the well completion process. After the cementing is completed a drilling out of the inside diameter of the well casing or tubular walls would occur which would also in the process remove the temporary orientation key 16, the temporary mule shoe 15 and the temporary cover 14, which prevented the longitudinal window 11, and at least one key-way 12 from allowing fluid flow of the cement outward from the longitudinal window 11 or fluid flow from the well into the well casing or tubular walls 26.

The well would now be ready for the next step of setting the whip stock 21. The whip stock 21 which has slidably connected to it a key tool 24 with a key 25 compressed back into the key tool 24 on a spring 35 while being lowered with the whip stock 21 into position in the casing 24. Upon the key tool 24 reaching the longitudinally premilled window 11 the spring 35 would drive the key 25 into the longitudinally premilled window 11 and stop the rotation of the running tool 20 with the whipstock 21 mounted to it. This would provide the first indication that the whip stock and key means have reached the desired location in the well. After this indication that the whip stock 21 has reached the desired location the operator would cease the rotation of the whipstock 21 and perform the step of lowering the whipstock 21, key tool 24, and key 25 downward. Thus as the whipstock 21, key tool 24, and key 25 are lowered downward the key 25 would be guided by the "window sills" 32 of the longitudinally premilled window 11 in to communication with the key way 12. This then commences the step of sliding key 25 into the key way 12 and against the U-shaped back portion 33 of the key way 12 which brings the key tool 24 and key 24 to a stop, while the whip stock 21 continues downward by it slidable conection over the mandrel 63. However the whipstock 21 which has a slidable connection to the mandrel 63 continues its downward motion putting pressure on the stopped packer 34 and thus causes the packer 34 to be compressed and expanded outward. Once expanded outward the packer 34 sets and the whipstock 21 is stopped in the desired location for the drilling operations to commence.

The use of the assembly of this invention may be used with the method steps of running a reentry tool 46 down hole with a key tool 48 and spring loaded key 64 located thereon for being received into the longitudinally premilled window 11. Once received into the longitudinally premilled window 11 pulling uphole to set the key tool 48 and key 64 in said second orientation key way 13, would occur. As those skilled in the art will appreciate once the key tool 48 and spring loaded key 64 are set in the second orientation key way 13 an operational platform will be established with specific orientation of the reentry tool 46 relative to the longitudinally premilled window and the lateral well bore, which at this stage should already be drilled, for the reentry into the drilled lateral well bore. At least one method for the reentry into the lateral well bore would be the step of kicking said reentry tool 46 by continued up hole motion, but as those skilled in the art will appreciate there would be many ways to kick a reentry tool 46 once an operational platform has been created in a known orientation relative to the longitudinally premilled window 11 and the lateral well bore. Just for example those skilled in the art would be aware of hydraulic kick tools, electrical kick tools, and mechanical kick tools just to name a few which might be used to kick the kick tool 47 into the lateral well bore. Once kicked out, the step of lowering the reentry tool 46 would occur whether the lowering occurs while the key tool 48 and spring loaded key 64 and the second orientation key-way 13 remain engaged and the reentry is through the key tool 48 or the key tool 48 is used in the reentry process.

While the preferred embodiments of the invention and the methods of their use have been described for the assembly for providing a means of support and positioning for drilling at least one multi-lateral well from a well bore in a well having tubular walls and for providing a means for entry and reentry into and through the longitudinally premilled wind and their use, it will be appreciated that other embodiments and methods may be used without departing from the spirit of the invention.

What is claimed is:

1. An assembly for providing means of support and positioning for drilling at least one multi-lateral well from a well bore in a well having a tubular wall and for providing means for entry and reentry into and through a longitudinally premilled window in the at least one multi-lateral well comprising, a junction section means for drilling at least one multi-lateral well and for providing entry and reentry into the at least one multilateral well having a tubular wall and having a longitudinally premilled window formed in said tubular wall with a down hole portion and an up hole portion; and a first orientation key-way means for allowing communication with said longitudinally premilled window and for providing support and positioning for drilling said multi-lateral well, and said first orientation key-way means being located substantially on the down hole portion of said longitudinally premilled window.

2. An assembly for providing means of support and positioning for drilling at least one multi-lateral well from a well bore in a well having a tubular walls and for providing means for entry and reentry into and through a longiudinally premilled window in the at least one multi-lateral well as in claim 1 wherein said first orientation key-way means further comprises, a first substantially U-shaped channel means for being in communication with said longitudinally premilled window in said junction section means.

3. An assembly for providing means for providing means of support and positioning for drilling at least one multi-lateral well from a well bore in a well having a tubular wall and for providing means for entry and reentry into and through a longitudinally premilled window in the at least one multi-lateral well as in claim 2 further comprising, a second orientation key-way means for allowing communication with said longitudinally premilled window and for providing support and positioning for entry and reentry into and through said longitudinally premilled window in at least one multi-lateral well, and said second orientation key-way means being located substantially on the up hole portion of said longitudinally premilled window.

4. An assembly for providing means of support and positioning for drilling at least one multi-lateral well from a well bore in a well having a tubular wall and for providing means for entry and reentry into and through a longitudinally premilled window in the at least one multi-lateral well as in claim 3 wherein said second orientation key-way means further comprises, a second substantially U-shaped channel means for being in communication with said longitudinally premilled window in said junction section means.

5. An assembly for providing means of support and positioning for drilling at least one multi-lateral well from a well bore in a well having a tubular wall and for providing means for entry and reentry into and through a longitudinally premilled window in the at least one multi-lateral well as in claim 4 wherein said first substantially U-shaped channel means and second substantially U-shaped channel means are positioned for substantial vertical alignment with each other.

6. An assembly for providing means of support and positioning for drilling at least one multi-lateral well from a well bore in a well having a tubular walls and for providing means for entry and reentry into and through a longitudinally premilled window in the at least one multi-lateral well as in claim 5 further comprising, a whip stock means for providing a directional platform for drilling the at least one multilateral well therefrom; and a key means for being received into said longitudinally premilled window and for engagement with said first orientation key-way means in said junction section means as said whip stock means is lowered further down hole after said key means has been received into said longitudinally premilled window.

7. An assembly for providing means of support and positioning for drilling at least one multi-lateral well from a well bore in a well having a tubular wall and for providing means for entry and reentry into the at least one multi-lateral well as in claim 6 wherein said key means further comprises;

a key member means for engagement with said longitudinally premilled window and said first orientation key-way means having a down hole hooked surface, and a spring means for being compressed when said key member means is in said tubular wall of said well and for driving said key means into said longitudinally premilled window when said key member is positioned at said longitudinally premilled window.

8. An assembly for providing a means of support and positioning for drilling at least one multi-lateral well from a well bore in a well having a tubular wall and for providing means for entry and reentry into and through a longitudinally premilled window in at least one multi-lateral well as in claim 7 further comprising, a mandrel means, an expandable head means for expansion in response to said key member means holding said expandable head means in place after said key member means is seated in said key way means and as said whip stock means is lowered further into said well for securing said expandable head means in a fixed position in said tubular wall of said well, a first collet locking means for connection to said mandrel means between said expandable head means and said key means and said key means; and a second collet locking means for connection to said whip stock means and for locking engagement with said first collet locking means and for storing energy created in said expansion of expandable head means until said collets are pulled apart.

9. An assembly for providing means of support and positioning for drilling at least one multi-lateral well from a well bore in a well having a tubular wall and for providing a means for entry and reentry into the at least one multi-lateral well as in claim 8 wherein said expandable head means further comprises, a resilient packer body head means for expansion in response to said key means holding said resilient packer body head means from further movement downward as said whip stock presses downward to compress said packer body head means against said casing.

10. An assembly for providing means of support and positioning for drilling at least one multi-lateral well from a well bore in a well having a tubular wall and for providing means for entry and reentry into the at least one multi-lateral well as in claim 8 wherein said expandable head means further comprises, a spring means for storing mechanical energy created by said whip stock means being pushed down hole after said key means is seated in said key way for releasing said mechanical energy for aiding in uncompressing said expandable head and disengaging said first and second collet locking means located about said mandrel means and between said expandable head means and said key member means.

11. An assembly for providing means of support and positioning for drilling at least one multi-lateral well from a well bore in a well having a tubular wall and for providing means for entry and reentry into the at least one multi-laterall well as in claim 5 further comprising, a temporary cover means for closing said longitudinally premilled window and said first and second orientation key-ways from fluid communication there through and for providing orientation of said longitudinally premilled window and said first and second orientation key-ways.

12. An assembly for providing means of support and positioning for drilling at least one multi-lateral well from a well bore in a well having a tubular wall and for providing means for entry and reentry into the at least one multi-lateral well as in claim 11 wherein said temporary cover means further comprises, a non-metallic sleeve for forming a fluid seal across said longitudinally premilled window and said first and second orientation key-ways for preventing fluid communication there through and for providing a material that is soft and easy to remove.

13. An assembly for providing means of support and positioning for drilling at least one multi-lateral well from a well bore in a well having a tubular wall and for providing means for entry and reentry into the at least one multi-lateral well as in claim 11 wherin said temporary cover means further comprises, a soft metallic sleeve for forming a fluid seal across said longitludinally premilled window and said first and second orientation key-ways for preventing fluid communication there through, and for providing a material that is soft and easy to remove.

14. An assembly for providing means of support and positioning for drilling at least one multi-lateral well from a well bore in a well having a tubular wall and for providing means for entry and reentry into the at least one multi-lateral well as in claim 11 wherein said temporary cover means further comprises, a temporary orientation key for providing a positive means to determine said orientation of said longitudinally premilled window formed in said junction section means and said first and second orientation key-way means; and a temporary mule shoe means for aiding in positioning of said junction section means and said longitudinally premilled window formed therein located on the up hole position of said temporary cover means in the known orientation to said temporary orientation key.

15. An assembly for providing a means for providing a means of support and positioning for drilling at least one multi-lateral well from a well bore in a well having a tubular wall and for providing means for entry and reentry into and through a longitudinally premilled window in at least one multi-lateral well as in claim 4 further comprising, a reentry tool means for running tools for reentry; and a key means for being received into said longitudinally premilled window and for engagement with said second orientation key-way means in said junction section means as said reentry tool means and key means are raised up hole.

16. An assembly for providing means of support and positioning for drilling at least one multi-lateral well from a well bore in a well having a tubular wall and for providing a means for entry and reentry into and through a longitudinally premilled window in at least one multi-lateral well as in claim 15 wherein said key means located on said reentry tools means further comprises, a key member means for engagement with said longitudinally lpremilled window and said second orientation key-way means having an up hole hooked surface, and a spring means for being compressed when said key member means is in said tubular wall of said well and for driving said key member means into said longitudinally premilled window when said key member means is at said longitudinally premilled window.

17. An assembly for providing a means of support and positioning for drilling at least one multi-lateral well from a well bore in a well having a tubular wall and for providing means for entry and reentry into and through a longitudinally premilled window in at least one multi-lateral well as in claim 16 wherein said key means located on said reentry tool means further comprises, a slidable shifting sleeve means for being slid down hole upon up hole movement of said reentry tool means after said up hole hooked surface engages said second orientation key-way means, and a cam surface means for kicking said reentry tool means sufficiently outward from the down hole running position for said reentry tool means to enter said at least one multi-lateral well upon down hole movement of said reentry tool means.

18. An assembly for providing a means of support and positioning for drilling at least one multi-lateral well from a well bore in a well having a tubular wall and for providing means for entry and reentry into and through a longitudinally premilled window in at least one multi-lateral well as in claim 17 wherein said key means located on said reentry tool means further comprises, a first griping surface means on said slidable shifting sleeve means, and a second griping surface means for engaging and disengaging said first griping surface means upon movement between said slidable shifting sleeve means and said second griping surface means.

19. An assembly for providing means of support and positioning for drilling at least one multi-lateral well from a well bore in a well having a tubular wall and for providing means for entry and reentry into and through a longitudinally premilled window in the at least one multi-lateral well comprising, a junction section member having a tubular wall and having the longitudinally premilled window formed in said tubular wall with a down hole portion and an up hole portion; and a first orientation key-way member formed in said tubular wall of said junction section member and in communication with said longitudinally premilled window and located substantially on the down hole portion of said longitudinally premilled window for allowing communication with said longitudinally premilled window and for providing support and positioning for drilling said multi-lateral well.

20. An assembly for providing means of support and positioning for drilling at least one multi-lateral well from a well bore in a well having a tubular walls and for providing means for entry and reentry into and through a longitudinally premilled window in the at least one multi-lateral well as in claim 19 wherein said first orientation key-way member further comprises, a first substantially U-shaped channel member formed with an open end of said U-shaped channel member to be in communication with said longitudinallly premilled window in said junction section member.

21. An assembly for providing means of support and positioning for drilling at least one multi-lateral well from a well bore in a well having a tubular wall and for providing means for entry and reentry into and through a longitudinally premilled window in the at least one multi-lateral well as in claim 20 further comprising, a second orientation key-way member formed in said wall of said junction section member and in communication with said longitudinally premilled window and located substantially on the up hole portion of said longitudinally premilled window for allowing communication with said longitudinally premilled window and for providing support and positioning for entry and reentry into and through said longitudinally premilled window in at least one multi-lateral well.

22. An assembly for providing means of support and positioning for drilling at least one multi-lateral well from a well bore in a well having a tubular wall and for providing means for entry and reentry into and through a longitudinally premilled window in the at least one multi-lateral well as in claim 21 wherein said second orientation key-way member further comprises, a second substantially U-shaped channel member having the open end of said U-shaped channel member in communication with said longitudinally premilled window in said junction section member.

23. An assembly for providing means of support and positioning for drilling at least one multi-lateral well from a well bore in a well having a tubular wall and for providing means for entry and reentry into and through a longitudinally premilled window in the at least one multi-lateral well as in claim 22 wherein said first substantially U-shaped channel member and second substantially U-shaped channel member are positioned in said junction section member having said longitudinally premilled window in substantial vertical alignment with each other.

24. An assembly for providing means of support and positioning for drilling at least one multi-lateral well from a well bore in a well having a tubular walls and for providing means for entry and reentry into and through a longitudinally premilled window in the at least one multi-lateral well as in claim 23 further comprising, a whip stock member having an inclined surface for providing a directional platform for drilling the at least one multilateral well therefrom; and a key member located on said whip stock member for being received into said longitudinally premilled window and for engagement with said first orientation key-way member in said junction section member as in said whip stock member is lowered further down hole after said key member has been received into said first orientation key-way member.

25. An assembly for providing means of support and positioning for drilling at least one multi-lateral well from a well bore in a well having a tubular wall and for providing means for entry and reentry into the at least one multi-lateral well as in claim 24 wherein said key member located on said whip stock member further comprises;

a key member having a down hole hooked surface for engagement with said longitudinally premilled window and said first orientation key-way member, and a spring member for being compressed when said key member member is in said tubular wall of said well and for driving said key member member into said longitudinally premilled window when said key member is positioned at said longitudinally premilled window.

26. An assembly for providing a means of support and positioning for drilling at least one multi-lateral well from a well bore in a well having a tubular wall and for providing a means for entry and reentry into and through a longitudinally premilled window in at least one multi-lateral well as in claim 25 further comprising, a mandrel member, an expandable head member connected to said mandrel member and to said key for holding said expandable member in place after said key member is seated in said key way member and connected in sliding engagement to said whip stock member for expanding said expandable member as said whip stock member is lowered further into said well for securing said expandable member in a fixed position in said tubular wall of said well, a first collet locking member connected to said mandrel between said expandable head member and said key member; and a second collet locking member connected to said whip stock member for locking engagement with said first collet locking member and for storing energy created in said expansion of expandable member until said collets are pulled apart.

27. An assembly for providing means of support and positioning for drilling at least one multi-lateral well from a well bore in a well having a tubular wall and for providing a means for entry and reentry into the at least one multi-lateral well as in claim 26 wherein said expandable head member further comprises, a resilient packer body head member for expansion in response to said key member holding said resilient packer body head member from further movement downward as said whip stock presses downward to compress said packer body head member against said tubular wall in said well bore.

28. An assembly for providing means of support and positioning for drilling at least one muli-lateral well from a well bore in a well having a tubular wall and for providing means for entry and reentry into the at least one multi-lateral well as in claim 26 wherein said expandable head member further comprises, a spring member located about said mandrel member and between said expandable head member and said key member for storing mechanical energy created by said whip stock member being pushed down hole after said key member is seated in said key way member for releasing said mechanical energy for aiding in uncompressing said expandable head and disengaging said first and second collet locking member.

29. An assembly for providing means for support and positioning for drilling at least one multi-lateral well from a well bore in a well having a tubular wall and for providing means for entry and reentry into the at least one multi-lateral well as in claim 23 further comprising, a temporary cover member for closing said longitudinally premilled window and said first and second orientation key-ways from fluid communication there through and for providing orientation of said longitudinally premilled window and said first and second orientation key-ways.

30. An assembly for providing means of support and positioning for drilling at least one multi-lateral well from a well bore in a well having a tubular wall and for providing means for entry and reentry into the at least one multi-lateral well as in claim 29 wherein said temporary cover member further comprises, a non-metallic sleeve to form a fluid seal across said longitudinally premilled window and said first and second orientation key-ways for preventing fluid communication there through and for providing a material that is soft and easy to remove.

31. An assembly providing means of support and positioning for drilling at least one multi-lateral well from a well bore in a well having a tubular wall and for providing means for entry and reentry into the at least one multi-lateral well as in claim 29 wherein said temporary cover member further comprises, a soft metallic sleeve to form a fluid seal across said longitudinally premilled window and said first and second orientation key-ways for preventing fluid communication there through, and for providing a material that is soft and easy to remove.

32. An assembly for providing means of support and positioning for drilling at least one multi-lateral well from a well bore in a well having a tubular wall and for providing means for entry and reentry into the at least one multi-lateral well as in claim 29 wherein said temporary cover member further comprises, a temporary orientation key located in said junction section member in a known orientation to said first and second orientation key-way member for providing a positive means to determine said orientation of said longitudinally premilled window formed in said junction section member and said first and second orientation key-way member; and a temporary mule shoe member formed on the up hole portion of said temporary cover member in the known orientation to said temporary orientation key for aiding in positioning of said junction section member and said longitudinally premilled window formed therein.

33. An assembly for providing a means of support and positioning for drilling at least one multi-lateral well from a well bore in a well having a tubular wall and for providing a means for entry and reentry into and through a longitudinally premilled window in at least one multi-lateral well as in claim 22 further comprising, a reentry tool member for running tools for reentry; and a key member located on said reentry tool member for being received into said longitudinally premilled window and for engagement with said second orientation key-way member in said junction section member as said reentry tool member and key member are raised up hole.

34. An assembly for providing means of support and positioning for drilling at least one multi-lateral well from a well bore in a well having a tubular wall and for providing a means for entry and reentry into and through a longitudinally premilled window in at least one multi-lateral well as in claim 33 wherein said key member located on said reentry tools member further comprises, a key element member having an up hole hooked surface for engagement with said longitudinally premilled window and said second orientation key-way member, and a spring member for being compressed when said key element member is in said tubular wall said well and for driving said key element member into said longitudinally premilled window when said key element member is at said longitudinally premilled window.

35. An assembly for providing a means of support and positioning for drilling at least one multi-lateral well from a well bore in a well having a tubular wall and for providing means for entry and reentry into and through a longitudinally premilled window in at least one multi-lateral well as in claim 34 wherein said key member located on said reentry tool member further comprises, a slidable shifting sleeve member slidably positioned over said reentry tool during down hole running and connected to said key member having the up hole hooked surface for sliding down hole said slidable shifting sleeve member upon up hole movement of said reentry tool member after said up hole hooked surface engages said second orientation key-way member, and a cam surface member on said slidable shifting sleeve member for kicking said reentry tool member sufficiently outward from the down hole running position for said reentry tool member to enter said at least one multi-lateral well upon down hole movement of said reentry tool member.

36. An assembly for providing a means of support and positioning for drilling at least one multi-lateral well from a well bore in a well having a tubular wall and for providing means for entry and reentry into and through a longitudinally premilled window in at least one multi-lateral well as in claim 35 wherein said key member located on said reentry tool member further comprises, a first griping surface member on said slidable shifting sleeve member, and a second griping surface surface on said reentry tool member for engaging and disengaging said griping surface on said slidable shifting sleeve member upon movement between said slidable sleeve member and said reentry tool member.

37. A method for drilling at least one multi-lateral well from a well bore in a well having a tubular wall comprising;

adding a junction section member having a premilled window and at least one orientation key-way in communication with said premilled window to a well having a tubular wall;

orientating the tubular wall and said junction section in the well bore with a temporary orientation key;

setting a whip stock member which has a compressed spring key for opening in said premilled window of the junction section member;

sliding said opened uncompressed spring key into said at least one orientation key way formed as part of the longitudinally premilled window for locking engagement as said whip stock member is lowered into said orientation key member for precise orientation;

drilling the at least one multi-lateral well by deflecting said drill bit off said whip stock as said multi-lateral well is drilled.

38. The method for drilling at least one multi-lateral well from a well bore in a well having tubular walls as in claim 37 further comprising;

positioning a resilient packer body member to be set after said key member stops the advance of said packer down hole and expanding said resilient packer body member by continuing to move said whip stock member down hole after said key member and resilient packer body member have stopped downward advance.

39. A method for drilling at least one multi-lateral well from well bore in a well having a tubular wall comprising.

adding a junction section having at least one premilled window and at least one orientation key-way in communication with said premilled window to said tubular wall in a well bore;

orientating the tubular wall and said junction section in the well bore with a temporary orientation key;

setting a whip stock member which has a compressed spring key for opening in said premilled window of the junction section;

cementing said well casing and said junction section in proper orientation;

drilling out said cement, and a temporary orientation key, and a temporary mule shoe carried by a temporary cover closing said premilled window from fluid communication.

40. A method for entry and reentry into and through the longitudinally premilled window in at least one multi-lateral well comprising, running a reentry tool member having a spring driven key member down hole into a longitudinally premilled window having at least one orientation key way located uphole in the longitudinally premilled window and in communication therewith;

pulling up hole after reaching said longitudinally premilled window which is determined by the spring driven key member opening into said longitudinally premilled window, seating the spring driven key member located on said reentry tool member by said up hole motion into said at least one orientation key way;

kicking said reentry tool member out by continued up hole motion; and lowering said reentry tool member down with said reentry tool member kicked out for entry into said at least one multi-lateral well.

41. The method for entry and reentry into and through the longitudinally premilled window in at least one multi-lateral well as in claim 40 wherein kicking said reentry tool member out by continued up hole motion further comprises, shifting a slidable shifting sleeve having a caming surface for kicking said reentry tool member outward by engaging a key member having an up hole hooked surface against the at lease one orientation key-way and pulling uphole on said reentry tool member.

42. The method for entry and reentry into and through the longitudinally premilled window in at least one multi-lateral well as in claim 40 further comprising, lowering a key element member having an up hole hooked surface off said the at least one orientation keyway, and rotating said spring driven key member having an up hole hooked surface in said longitudinally premilled window;

engaging said key element member against said whip stock member, and shifting said slidable shifting sleeve away from said caming surface for kicking said reentry tool member outward by pushing downhole on said reentry tool member.

* * * * *